US005686929A

United States Patent [19]

Thiere et al.

[11] Patent Number: 5,686,929

[45] Date of Patent: Nov. 11, 1997

[54] RF HOMING HEAD ANTENNA SYSTEM FOR MISSILES

[75] Inventors: Helmuth Thiere, Munich; Anton Brunner, Starnberg; Peter Fritsche, Salem, all of Germany

[73] Assignees: Siemens Aktiengesellschaft, Munich; Bodenseewerk Geraetetechnik GmbH, Ueberlingen, both of Germany

[21] Appl. No.: 547,537

[22] Filed: Oct. 24, 1995

[30] Foreign Application Priority Data

Oct. 25, 1994 [DE] Germany ..... 44 38 089.5

[51] Int. Cl.[6] ..... H01Q 11/10; H01Q 21/26

[52] U.S. Cl. ..... 343/792.5; 343/797; 343/814

[58] Field of Search ..... 343/792.5, 797, 343/798, 799, 800, 814, 853, 872, 778; 342/371, 372, 374

[56] References Cited

U.S. PATENT DOCUMENTS

| | | | |
|---|---|---|---|
| 2,270,130 | 8/1942 | Laport | 343/797 |
| 2,414,103 | 7/1947 | Hunter | 343/799 |
| 3,147,479 | 9/1964 | Williams | 343/792.5 |
| 3,273,158 | 9/1966 | Fouts et al. | 343/797 |
| 4,348,677 | 9/1982 | Salmond | 343/798 |
| 4,360,816 | 11/1982 | Corzine | 343/792.5 |
| 4,490,725 | 12/1984 | Kuo | 343/792.5 |
| 4,977,408 | 12/1990 | Harper et al. | 343/792.5 |
| 5,274,390 | 12/1993 | Breakall | 343/792.5 |
| 5,451,969 | 9/1995 | Toth et al. | 343/729 |

FOREIGN PATENT DOCUMENTS

| | | |
|---|---|---|
| 0198578 | 10/1986 | European Pat. Off. . |
| 2 407 486 | 5/1979 | France . |

OTHER PUBLICATIONS

Microwave Journal, Sep. 1984, "Fixed Beam and Mechanically Steerable Antennas", George S. Hardle et al, pp. 143–156.

IRE Transactions On Antennas and Propagation, May 1960, "Log Periodic Dipole Arrays", D.E. Isbell, pp. 260–267.

*Primary Examiner*—Donald T. Hajec
*Assistant Examiner*—Tan Ho
*Attorney, Agent, or Firm*—Hill, Steadman & Simpson

[57] ABSTRACT

A RF antenna system mounted on, for example, a dielectric carrier plate is accommodated as a homing head in the front under a radome in a missile provided for locating radar systems or the like, in addition to other, further sensors potentially present in free spaces. The RF antenna system is composed of a three's or four's group of logarithmic-periodic crossed dipole antennas whose long axes proceed with optimized dimension obliquely relative to one another and that are interconnected with a monopulse feed network for taking aggregate and difference diagrams in azimuth and elevation. The antenna system for long-range missiles enables a monopulse position fixing in azimuthal or, respectively, elevational direction in an extremely broad frequency range.

16 Claims, 5 Drawing Sheets

A
B
C

DIVIDER
58
61
HYBRID
63
3dB/
0°
3dB/
180°
+
64
ΔEl
65
DIVIDER
3dB/
0°
+
+
Σ
3dB/
180°
3dB/
180°
−
−
59
3dB/
180°
−
−
ΔAz
66
3dB/
0°
+
HYBRID
HYBRID
HYBRID
62
HYBRID
DIVIDER
57
60

RF HOMING HEAD ANTENNA SYSTEM FOR MISSILES

BACKGROUND OF THE INVENTION

The present invention is directed to an antenna system accommodated in a missile.

For locating targets, a long-range missile for finding radar systems or the like requires a RF antenna system that enables a monopulse position fixing in azimuthal or, respectively, elevational direction in an extremely broad frequency range given optimally all polarizations. Since other sensors, for example optronic or, respectively, millimeter wave sensors, are to be utilized for the target locating and target tracking in such a missile in addition to the RF radar homing head dependent on the stated objective, the RF antenna system must be compatible with these systems with respect to space requirement and undisturbed functioning. This means that no blanking or occlusion dare arise due to a closed surface or component parts of the antenna.

Missiles having multisensor systems, i.e. with RF antennas and optronic sensors, are known for locating radar systems. A four-armed, planar helical antenna is thereby employed as RF antenna that, with the assistance of a complex, passive feed network and hybrid couplers, can be operated in aggregate mode and difference mode over an extremely broad bandwidth.

The helical antenna is in fact a broadband antenna form but it works in a highly limited way in view of the polarization. Due to its structure and its functioning, namely, the rotational sense of the imminent circular polarization is determined. It can process either right-circular or left-circular polarization and the respective polarization components. The aperture diameter of the helical antenna is the determining factor for the lowest operating frequency. The difference mode M2 requires a scope of the emitting, active region of at least two wavelengths.

An alternative, likewise planar antenna form, what is referred to as the sine antenna disclosed by European reference EP 0 198 578 B1 and that, viewed electrically, is related to the logarithmic-periodic dipole antenna can acquire all polarizations. In order, however, to be able to implement a monopulse location fixing with a difference mode similar to that in the helical antenna, it would have to comprise at least eight arms. An even more complex feed network than given the helical antenna would also be required for that purpose. Sine antennas having more than four arms that have an aperture diameter of, for example, half a wavelength at the lowest operating frequency, however, are still unavailable.

SUMMARY OF THE INVENTION

An object of the present invention is to provide a very broadband RF homing head antenna system suitable for monopulse position fixing that is effective over a plurality of octaves for a missile that is compatible with further sensors in view of space requirement and undisturbed functioning and that allows any arbitrary polarization.

In general terms the present invention is an RF homing head antenna system acting very broadband over a plurality of octaves and accommodated in the front of a missile suitable for locating radar devices or the like. The antenna system is composed of a group of individual antennas attached in close spatial proximity on, for example, a dielectric carrier plate. The antennas are interconnected via a monopulse feed network such that an amplitude and phase comparison of aggregate and difference diagrams in elevation and azimuth can be implemented. Four logarithmic-periodic crossed dipole antennas are provided as individual antennas of the group, the long axes thereof proceeding inclined relative to one another such that the phase centers of the respectively active cross dipoles lie apart by a maximum of about $0.7\cdot\lambda$ in the entire range of operating frequencies.

In general terms the present invention is also an RF homing head antenna system acting very broadband over a plurality of octaves and accommodated in the front of a missile suitable for locating radar devices or the like. The antenna system is composed of a group of individual antennas attached in close spatial proximity on, for example, a dielectric carrier plate. The antennas are interconnected via a monopulse feed network such that an amplitude and phase comparison of aggregate and difference diagrams in elevation and azimuth can be implemented. In this embodiment three logarithmic-periodic crossed dipole antennas are provided as individual antennas of the group, the long axes thereof proceeding inclined relative to one another such that the phase centers of the respectively active cross dipoles lie apart by a maximum of about $0.7\cdot\lambda$ in the entire range of operating frequencies.

Advantageous developments of the present invention are as follows.

The dipoles of the logarithmic-periodic crossed dipole antennas are half wave dipoles whose ends are capacitatively loaded.

The group composed of the logarithmic-periodic crossed dipole antennas is accommodated in the front of the missile such that free spaces result in the missile cross section wherein further sensors, for example optronic or millimeter wave sensors, can be arranged.

The three logarithmic-periodic crossed dipole antennas are arranged relative to one another such that their phase centers form the corner points of an equilateral triangle whose base proceeds horizontally.

The three logarithmic-periodic crossed dipole antennas are arranged such relative to one another that their phase centers form the corner points of an equilateral triangle whose base proceeds vertically.

The three 3 db dividers are provided in the monopulse feed network whose input is respectively connected to one of the three logarithmic-periodic crossed dipole antennas. Respectively one output of those two 3 db dividers that have their input side connected to the logarithmic-periodic crossed dipole antennas having their phase centers lying in the two base corner points of the equilateral triangle connected to a terminating impedance. The other output is conducted to an input of respectively one of two 3 db/180° hybrid circuits whose respectively second input is connected to a respective output of the third 3 db divider that has its input connected to that logarithmic-periodic crossed dipole antenna that does not lie in a base corner point of the equilateral triangle. The respective difference output of the two 3 db/180° hybrid circuits is connected to an input of a first, further 3 db/180° hybrid circuit and the respective aggregate output of the two 3 db/180° hybrid circuits is connected to an input of a second, further 3 db/180° hybrid circuit. The overall difference signal in the elevation or, respectively, the overall difference signal in the azimuth appears at the two outputs of the first, further 3 db/180° hybrid circuit and the overall aggregate signal appears at the aggregate output of the second, further 3 db/180° hybrid circuit at whose difference output is connected to a terminating impedance.

The logarithmic-periodic dipole antenna is known, for example, from the article by D. E. Isbell, "Log Periodic Dipole Arrays" in IRE Transactions on Antennas and Propagation, May 1960, pp. 260–267. It belongs to the nearly frequency-independent and, thus, extremely broadband antenna forms. In the crossed antenna embodiment, both orthogonal linear polarizations are available. All other polarizations can be received at one of the two outputs with a maximum loss of three db. A left-circular or, respectively, right-circular polarization can be formed free of polarization losses with the assistance of a 90°/3 db hybrid. Every polarization, without exception, can thus be processed over a very broad frequency band of several octaves. Similar to the planar sine antenna, there is also an "active" region for the emission behavior here that is dependent on the frequency. A plurality of half wave dipoles are always excited at the respective operating frequency.

According to the present invention, the long axes of the four or, respectively, three logarithmic-periodic crossed dipole antennas are obliquely inclined relative to one another such that the phase centers of the respectively active crossed dipoles lie apart by an approximate maximum of $0.7 \cdot \lambda$ in the entire range of operating frequency. Interferometer properties having an unbeneficial effect on the emission behavior are thus avoided, namely properties as would occur given an axially parallel arrangement with increasing frequency and, thus, electrical antenna spacings becoming greater and greater.

The mechanical dimensions can be substantially reduced in the lower frequency range by advantageously attached, capacitative loads at the ends of the half wave dipoles, so that a greatly reduced base diameter that still allows the attachment of other sensors can be achieved. Two unshortened half wave dipoles next to one another would otherwise require a dimension for the lower frequency that would possibly no longer allow the disturbance-free accommodation of further sensors.

The unfilled space in the missile cross section thus offers a beneficial integration possibility for further sensors such as, as required, for a millimeter wave antenna system with monopulse position fixing possibility or other sensors.

Compared to a four's-group system, a three's-group system requires less integration volume given logarithmic-periodic crossed dipole antennas that remain of about the same size. A larger cross sectional area is thus available in the missile for other sensors, for example optronic sensors.

The three's-group antenna system can be fashioned such that the three, logarithmic-periodic crossed dipole antennas are arranged such relative to one another that their phase centers form the corner points of an equilateral triangle whose base proceeds horizontally. The base can thereby either be at the top or bottom, so that one apex of the triangle is located exactly at the top or, respectively, bottom. In this case, the azimuthal symmetry is completely undisturbed. As needed, a triangular arrangement having the apex toward the top or toward the bottom can be more beneficial.

The three's-group antenna system, however, can also be fashioned such that the three logarithmic-period crossed dipole antennas are arranged such relative to one another that their phase centers form the corner point of an equilateral triangle whose base proceeds vertically. The base can thereby be either at the left or at the right side, so that an apex of the triangle is located at the outside right or, respectively, outside left. The elevational symmetry is completely undisturbed in this case.

In a four's-group antenna system, the signals of the respective, individual lobes of the four logarithmic-periodic crossed dipole antennas can be interconnected such in a traditionally fashioned monopulse comparator network that an amplitude and phase comparison of aggregate and difference diagrams can be implemented in elevation and azimuth.

Due to the azimuth and elevation difference necessary for monopulse for tracking in both planes, the broadband monopulse quality must also be taken into consideration in addition to the free area for other sensors in the horizontal and vertical spacings of the individual logarithmic-periodic crossed dipole antennas.

In a three's-group antenna system, the disturbed symmetry in the elevational diagram or, respectively, in the azimuthal diagram is corrected by the advantageous combination in the monopulse feed network.

Dual polarized, logarithmic-periodic dipole antennas for employment in equipment in the field of electronic support measures ESM are known from the article by G. S. Hardie, H. B. Sefton, Jr., "Fixed Beam and Mechanically Steerable Antennas", in the periodical Microwave Journal, September 1984, pp. 143–156, particularly pp. 149 and 150. In cross section, an embodiment described therein comprises a crossed shape and is composed of two orthogonally polarized, logarithmic-periodic dipole arrangements. It covers, for example, a frequency range of several octaves, whereby different polarizations can be set on the basis of the selection of one of the two dipole radiator rows (i.e., vertical or horizontal linear polarization) or by combination of the two output signals in a broadband 90 ° hybrid (i.e., left-circular polarization or right-circular polarization), and is enclosed in a foamed radome.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 1:
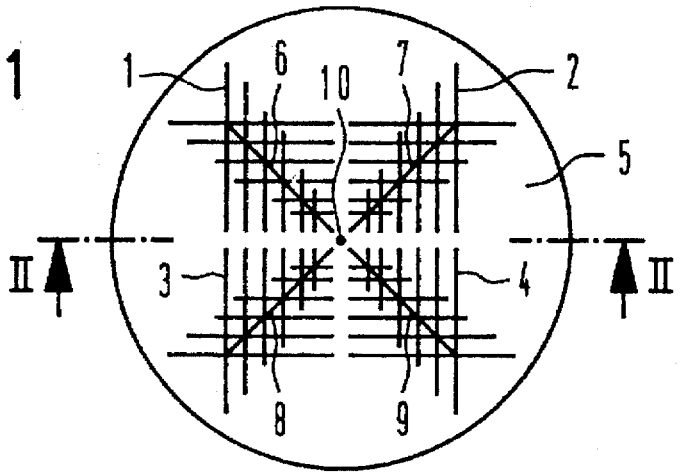
FIG. 1 depicts a the schematic arrangement of an antenna system of the present invention provided with four logarithmic-periodic crossed dipole antennas, shown in a view from the front.
Figure 2:
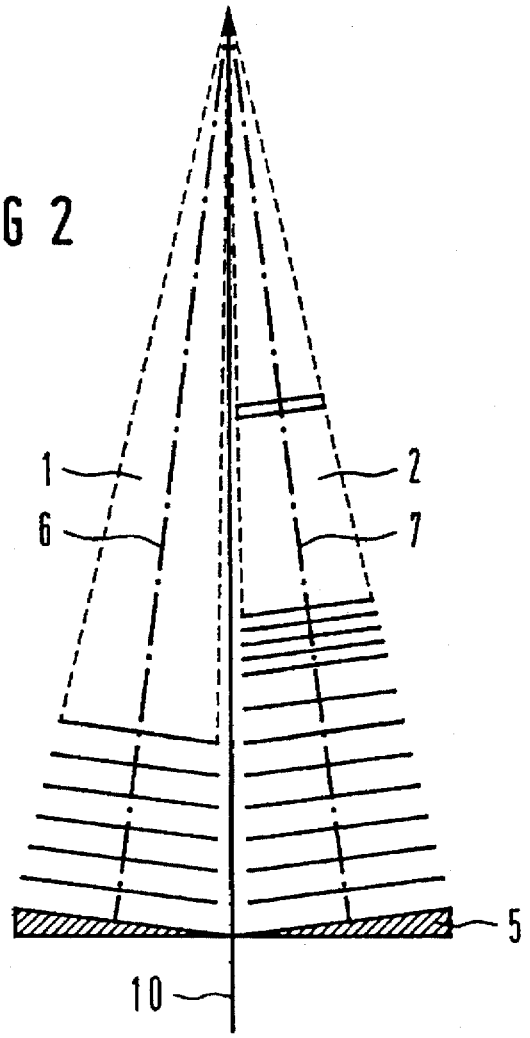
FIG. 2 is a sectional view II—II of the antenna system of FIG. 1.

FIG. 1, in a view from the front, and FIG. 2, in a sectional view II—II of FIG. 1, show an antenna group composed of four logarithmic-periodic crossed dipole antennas 1, 2, 3 and 4 arranged in close proximity that, as RF homing head antenna system, are to be accommodated at the front in a long-range missile for locating radar systems or the like. The four logarithmic-periodic crossed dipole antennas 1, 2, 3 and 4 are attached such on a circular, for example dielectric carrier plate 5 that the crossed dipole antennas 1 and 2 and the crossed dipole antennas 3 and 4 therebelow respectively lie horizontally side-by-side and the crossed dipole antennas 1 and 3, and next and 4 respectively crossed dipole antennas 2 and 4 respectively lie vertically under one another. The four logarithmic-periodic crossed dipole antennas 1, 2, 3 and 4 have their long axes 6, 7, 8 and 9 projecting toward the front, whereby symmetry exists with reference to a central axis 10 residing perpendicularly on the carrier plate 5. The two crossed dipole radiator rows of each crossed dipole antenna 1, 2, 3 and 4 see to it that the two orthogonal, linear polarizations are separately available and simultaneously available for a utilization of signals with respect thereto. The long axes 6, 7, 8, and 9 are inclined obliquely relative to one another such that the phase centers of the respectively active crossed dipole logarithmic-periodic crossed dipole antennas 1, 2, 3, and 4 lie part by a maximum of about $0.7\cdot\lambda$ in the entire range of operating frequencies.

Figure 3:
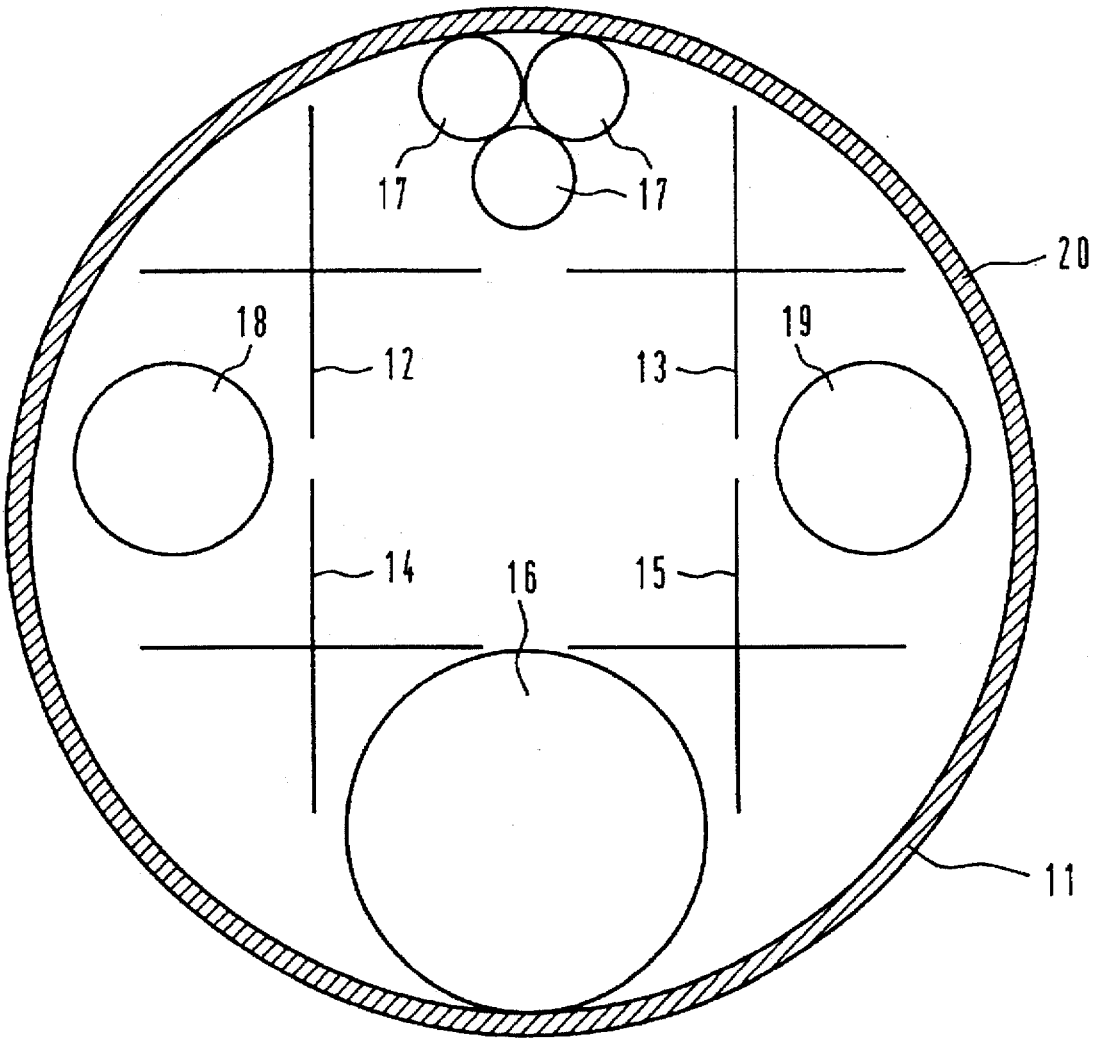
FIG. 3 depicts a schematic cross sectional view of an advantageous integration possibility of a "multi-mode" homing head that contains an antenna system of the present invention with four logarithmic-periodic crossed dipole antennas.

In a schematic cross sectional view, FIG. 3 shows an advantageous integration possibility of what is referred to as a "multi-mode" homing head that, among other things, contains a RF antenna system of the present invention. The RF antenna system acenterically attached on a circular, for example dielectric carrier plate 11 is composed of four logarithmic-periodic crossed dipole antennas 12, 13, 14 and 15 arranged in close proximity. Apart from the acentric position on the carrier plate 11, the four's-group composed of the four crossed dipole antennas 12, 13, 14 and 15 fundamentally coincides with that of FIGS. 1 and 2. As a result of the acentric offset of the four's group toward the top, however, a free space 16 arises wherein a further sensor can be arranged. This free space 16, just like the free spaces 17, 18 and 19, derives, for example, for an additional millimeter wave antenna system 17, a laser range finder 18 and a further sensor 19, deriving as a result of the special measure at the logarithmic-periodic crossed dipole antennas 12, 13, 14 and 15. Due to capacitative loads at the ends of the half wave dipoles of the four logarithmic-periodic crossed dipole antennas 12, 13, 14 and 15, namely, the mechanical dimensions in the lower frequency range can be substantially reduced, so that a considerably smaller base diameter than the diameter of the carrier plate 11 can be achieved for the four's group. Two unshortened half wave dipoles side-by-side would otherwise, i.e. without the capacitative loads, demand a dimension for the lower frequency that is somewhat larger than the diameter of the carrier plate 11. The unfilled space in the missile cross section within a radome 20 thus offers a favorable integration possibility for the millimeter wave antenna system at the location of the free space 17 and for further sensors at the locations of the free spaces 16, 18 and 19.

Figure 4:
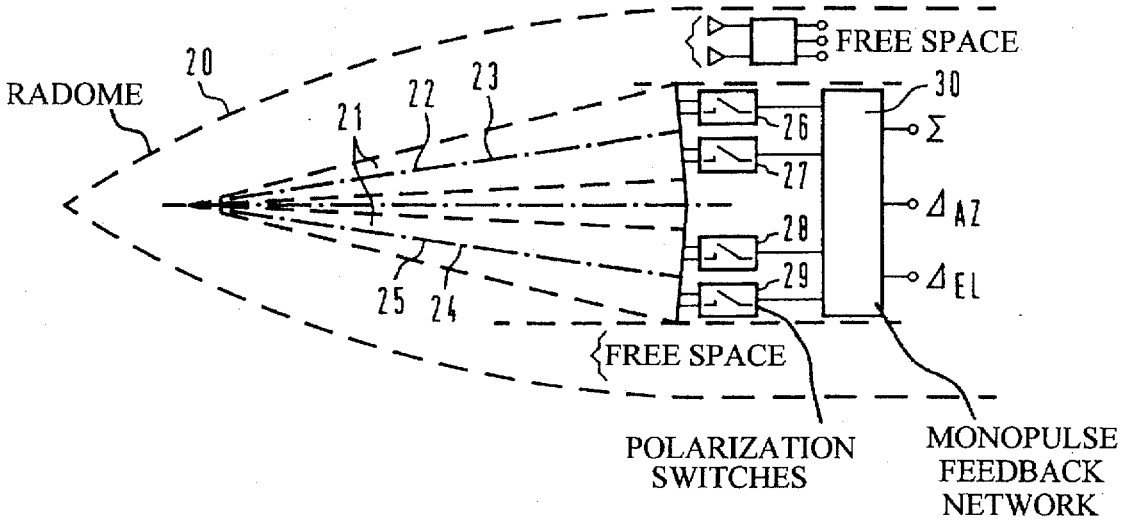
FIG. 4 depicts an advantageous installation possibility of an antenna system of the present invention in a schematic side view of the front part of a missile.

FIG. 4 shows a schematic side view of the front part of a missile wherein a RF homing head antenna system of the present invention with extremely broadband effect is accommodated under a radome 20. This antenna system is composed of a group 21 of four individual antennas arranged in close spatial proximity that are formed by logarithmic-periodic crossed dipole antennas. The long axes 22, 23, 24 and 25 (only the axes 23 and 25 of the two front crossed dipole antennas are visible in FIG. 4) of these logarithmic-periodic crossed dipole antennas proceed obliquely inclined relative to one another such that the respectively active crossed dipoles lie apart by a maximum of about $0.7\cdot\lambda$. The signals of the logarithmic-periodic crossed dipole antennas of the four's-group 21 are interconnected such via polarization switches 26, 27, 28 and 29 in a monopulse feed network 30 that an amplitude and phase comparison of aggregate and difference diagrams can be implemented in elevation and azimuth. In this exemplary embodiment, too, the dipoles of the four logarithmic-periodic crossed dipole antennas are half wave dipoles whose ends are capacitatively loaded, so that a substantially smaller base diameter of the four's-group 21 is achieved. The unfilled space in the missile cross section thus offers an extremely advantageous integration possibility for further sensors.

Figure 5:
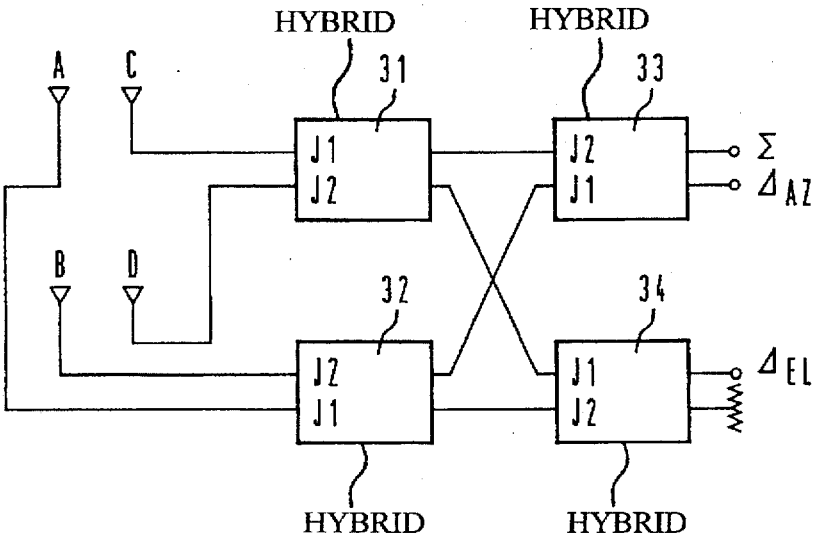
FIG. 5 is a schematic view of the circuitry of a monopulse feed network for an antenna system of the present invention having four logarithmic-periodic crossed dipole antennas.

FIG. 5 shows a block circuit diagram of a monopulse comparator network as provided, for example, in the arrangement of FIG. 4 as monopulse feed network 30. The signals coming from the four logarithmic-periodic crossed dipole antennas are referenced A, B, C and D. They are first supplied to two hybrid circuits 31 and 32 whose output signals then charge to further hybrid circuits 33 and 34. An aggregate sum signal $\Sigma$ as well as an aggregate difference signal $\Delta_{AZ}$ for the azimuth and an aggregate difference signal $\Delta_{EL}$ for the elevation are then output for every arbitrarily set polarization at the outputs of the two hybrid circuits 33 and 34. This traditionally constructed monopulse comparator network of FIG. 5 is thus interconnected such that an amplitude and phase comparison of aggregate and difference diagrams in elevation and azimuth can be implemented. It should be pointed out again that the logarithmic-periodic crossed dipole antenna is in the position to make both linear polarizations available. All other polarizations can be received at one of the two outputs with a maximum loss of three db. A left-circular or, respectively, right-circular polarization can be formed free of polarization losses with the assistance of a 90°/3 db hybrid.

Figure 6:
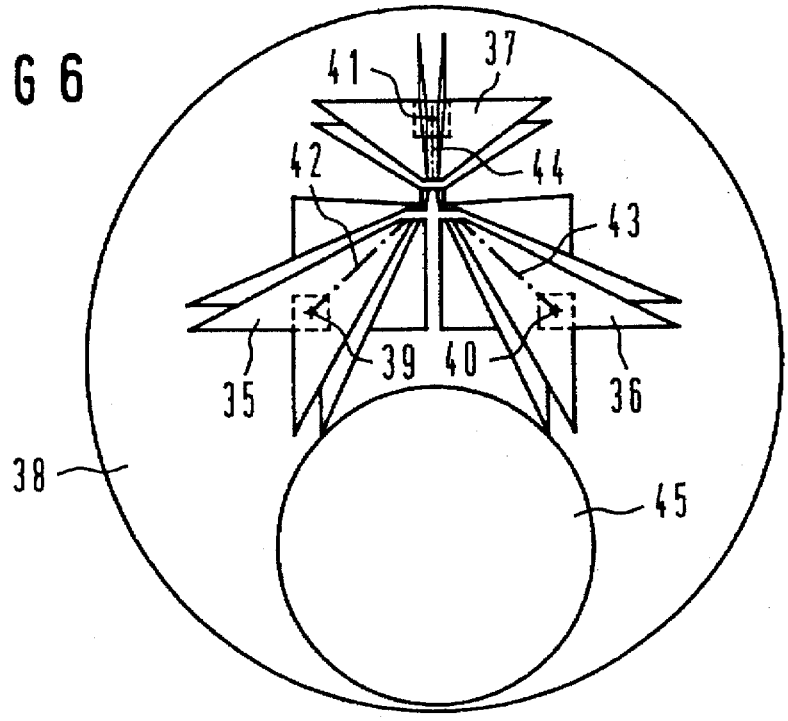
FIG. 6 depicts an arrangement of an antenna system of the present invention provided with three logarithmic-periodic crossed dipole antennas and having an additional sensor, shown in a view from the front.

In a view from the front, FIG. 6 shows an antenna group composed of three logarithmic-periodic crossed dipole antennas 35, 36 and 37 arranged in close spatial proximity that is to be accommodated as RF homing head antenna system in the front of a long-range missile for locating radar systems or the like. The three logarithmic-periodic crossed dipole antennas 35, 36 and 37 are attached such on a circular, for example dielectric carrier plate 38 that the two cross dipole antennas 35 and 36 respectively lie horizontally next to one another and the crossed dipole antenna 37 is centrally arranged thereabove. The three logarithmic-periodic crossed dipole antennas 35, 36 and 37 are arranged such relative to one another that their phase centers 39, 40 and 41 form the corner points of an equilateral triangle whose base proceeds horizontally. The base of this triangle is shown at the bottom in the exemplary embodiment illustrated in FIG. 6, so that an apex of the triangle is located exactly at the top. In this case, the azimuthal symmetry is completely undisturbed. The elevational symmetry, by contrast, is disturbed because only a single logarithmic-periodic crossed dipole antenna, namely the antenna 37, exists in the upper half of the antenna system and two logarithmic-periodic crossed dipole antennas, namely the antennas 35 and 36, are present in the lower half. The three logarithmic-periodic crossed dipole antennas 35, 36 and 37 have their long axes 42, 43 and 44 projecting toward the front. The two crossed dipole radiator rows of each crossed dipole antenna 35, 36 and 37 see to it that the two orthogonal linear polarizations are available separately and simultaneously for an evaluation of signals with respect thereto. The long axes 42, 43 and 44 are inclined obliquely relative to one another such that the phase centers 39, 40 and 41 of the respectively actively crossed dipole antennas 35, 36 and 37 lie apart by a maximum of about 0.7·λ in the entire range of operating frequencies. The unfilled space 45 in the missile cross section under the antenna system composed of the three logarithmic-periodic crossed dipole antennas 35, 36 and 37 offers a beneficial integration possibility for an additional sensor, for example an optronic sensor.

Figure 7:
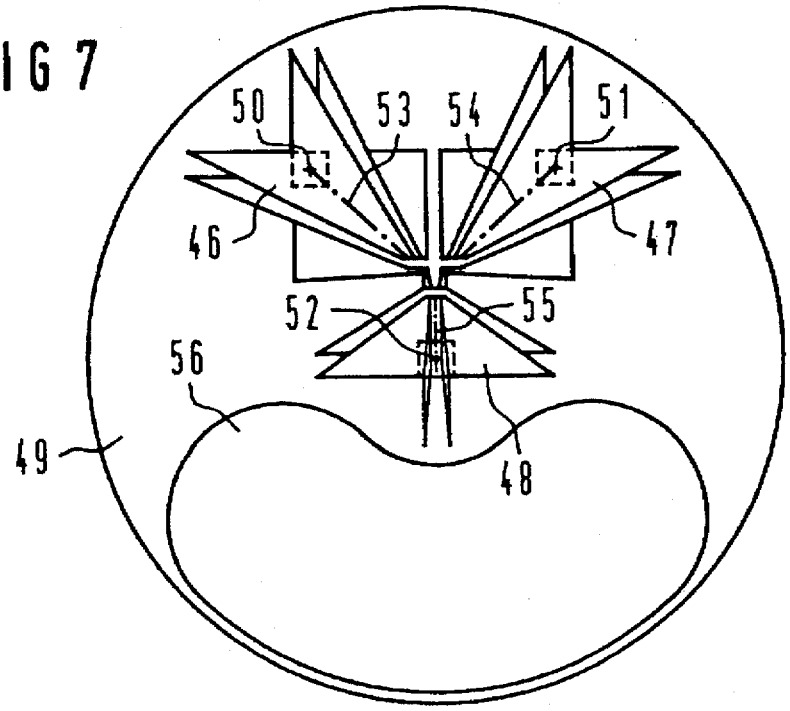
FIG. 7 depicts another arrangement of an antenna system of the present invention provided with three logarithmic-periodic crossed dipole antennas and with an additional sensor, likewise shown in a view from the front.

Likewise, in a view from the front, FIG. 7 shows an antenna group composed of three logarithmic-periodic crossed dipole antennas 46, 47 and 48 arranged in close proximity that are to be accommodated as a RF homing head antenna system in the front in a long-range missile for locating radar systems or the like. The three logarithmic-periodic crossed dipole antennas 46, 47 and 48 are attached such on a circular, for example, dielectric carrier plate 49 that the two crossed dipole antennas 46 and 47 respectively lie horizontally side-by-side and the crossed dipole antenna 48 is arranged centrally therebelow. The three logarithmic-periodic crossed dipole antennas 46, 47 and 48 are arranged such relative to one another that their phase centers 50, 51 and 52 form the corner points of an equilateral triangle whose base proceeds horizontally. The base of this triangle is at the top in the exemplary embodiment shown in FIG. 7, so that one apex of the triangle is located precisely at the bottom. In this case, the azimuthal symmetry is completely undisturbed, by contrast whereto the elevational symmetry is disturbed because to antennas are provided in the upper half of the antenna system and only one antenna is present in the lower half thereof. The three logarithmic-periodic crossed dipole antennas 46, 47 and 48 have their long axes 53, 54 and 55 projecting toward the front. The two crossed dipole radiator rows of each crossed dipole antenna 46, 47 and 48 see to it that the two orthogonal linear polarizations are available separately and simultaneously for an evaluation of signals with respect thereto. The long axes 53, 54 and 55 are inclined obliquely relative to one another such that the phase centers 50, 51 and 52 of the respectively active crossed dipole antennas 46, 47 and 48 lie apart by a maximum of about 0.7·λ in the entire range of operating frequencies. The unfilled space 56 in the missile cross section below the antenna system composed of the three logarithmic-periodic crossed dipole antennas 46, 47 and 48 offers a beneficial integration possibility for an additional sensor, for example and optronic sensor.

Figure 8:
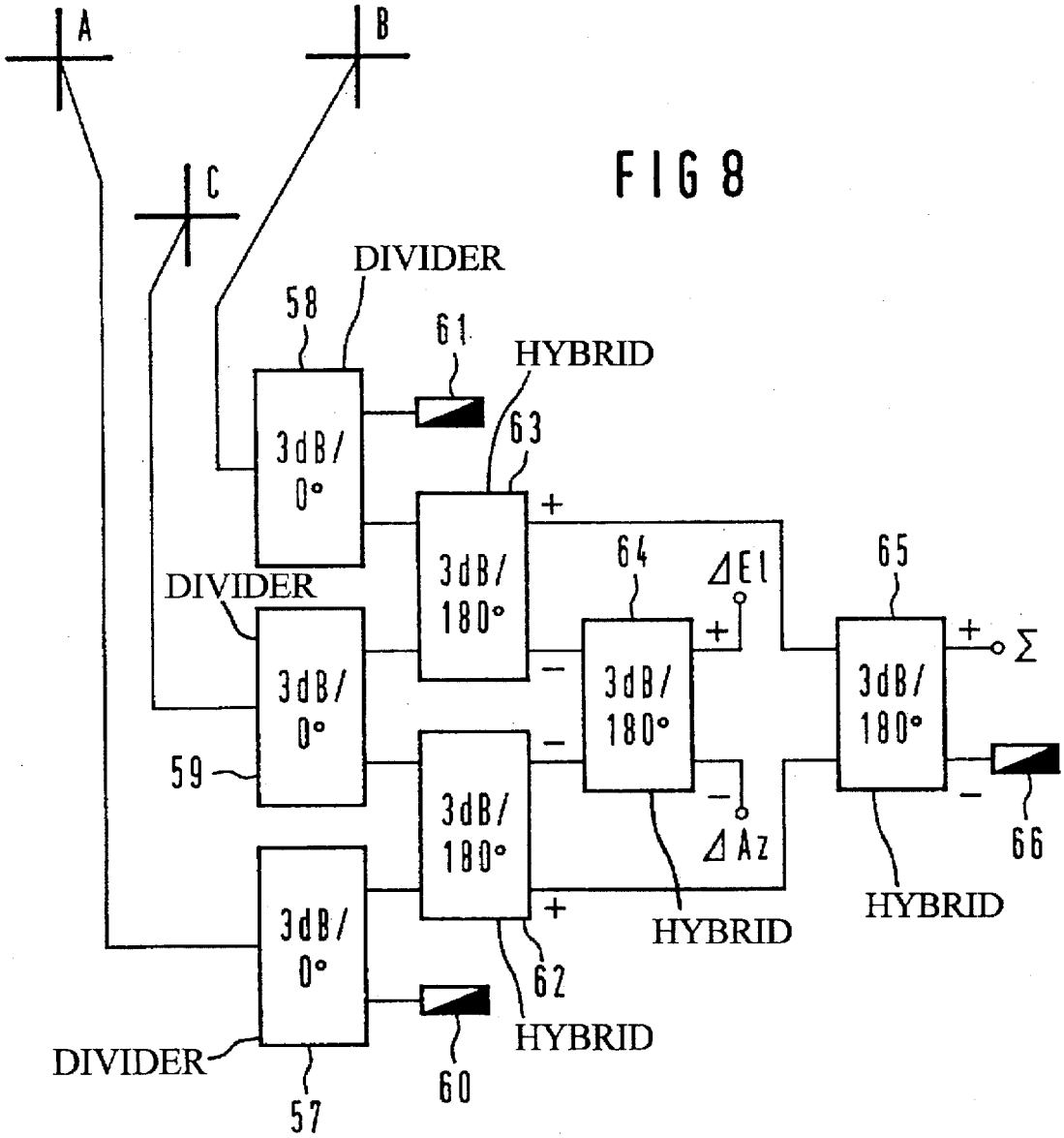
FIG. 8 is a schematic view of the circuitry of a monopulse feed network for an antenna system of the present invention having three logarithmic-periodic crossed dipole antennas.

In a block circuit diagram, FIG. 8 shows a monopulse feed network as can be expediently provided, for example, for the antenna system in the arrangement of FIG. 7. The signals coming from the three logarithmic-periodic crossed dipole antennas are referenced A, B, and C. Three 3 db dividers 57, 58 and 59 are provided in the illustrated monopulse feed network, their input being respectively connected to one of the three logarithmic-periodic crossed dipole antennas. The signal A thus proceeds to the 3 db divider 57, the signal B proceeds to the input of the 3 db divider 58, and the signal C proceeds to the input of the 3 db divider 59. Respectively one output of the two 3 db dividers 57 and 58, which thus are connected at their input side to the logarithmic-periodic crossed dipole antennas lying with their phase centers in the two base corner points of the equilateral triangle, is connected to a terminating impedance 60 or, respectively, 61. The other output of the two 3 db dividers 57 and 58 is conducted to an input of respectively one of two 3 db/180° hybrid circuits 62 and 63 whose respectively second input is connected to a respective output of the third 3 db divider 59 that, thus, has its input connected to the logarithmic-periodic crossed dipole antenna that does not lie in a base corner point of the equilateral triangle. The respective difference output of the two 3 db/180° hybrid circuits 62 and 63 is connected to an input of a first, further 3 db/180° hybrid circuit 64 and the respective aggregate output of the two 3 db/180° hybrid circuits 62 and 63 is connected to an input of a second, further 3 db/180° hybrid circuit 65. The overall difference signal $\Delta_{El}$ in the elevation or, respectively, the overall difference signal $\Delta_{Az}$ in the azimuth is adjacent at the two outputs of the first, further 3 db/180° hybrid circuit 64 and the overall aggregate signalΣ is adjacent at the sum output of the second, further 3 db/180° hybrid circuit 65 at whose difference output a terminating impedance 66 lies.

The disturbed elevational symmetry is corrected by the combination in the monopulse feed network shown in FIG. 8. This disturbance arises because two logarithmic-periodic crossed dipole antennas are present in elevational direction in the upper half of the antenna system and only a single such crossed dipole antenna is present in the lower half thereof. With the assistance of the monopulse feed network shown in FIG. 8, the overall difference signal $\Delta_{Az}$ in the azimuth is formed of the signals A and B deriving from the two antennas lying side-by-side, namely in the form of $$\Delta_{Az}=A/2-B/2$$

and the overall difference signal $\Delta_{ei}$ in the elevation is formed of the signals A, B and C deriving from all three antennas, being formed according to the equation $$\Delta_{El}=A/2+B/2-C.$$

The overall aggregate signal Σ is composed of the three signals A, B and C in the following way:

$$\Sigma=A/2+B/2+C.$$

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed:

1. An RF homing head antenna system that is very broadband over a plurality of octaves and that is accommodated in a front portion of a missile suitable for housing radar devices, comprising:

a group of individual antennas attached in close spatial proximity on a dielectric carrier plate;

a monopulse feed network for interconnecting the individual antennas of said group wherein an amplitude and phase comparison of aggregate and difference diagrams in elevation and azimuth are implemented;

individual antennas of said group being four logarithmic-periodic crossed dipole antennas, long axes thereof proceeding inclined relative to one another such that phase centers of respectively active cross dipoles are separated by a maximum of about 0.7·λ in an entire range of operating frequencies.

2. The antenna system according to claim 1, wherein the dipoles of the logarithmic-periodic crossed dipole antennas are half wave dipoles whose ends are capacitatively loaded.

3. The antenna system according to claim 1, wherein the group composed of the logarithmic-periodic crossed dipole antennas is accommodated in the front of the missile such that free spaces result in a missile cross section of the missile where further sensors are located.

4. An RF homing head antenna system that is very broadband over a plurality of octaves and that is accommodated in a front portion of a missile suitable for housing radar devices, comprising:

a group of individual antennas attached in close spatial proximity on a dielectric carrier plate;

a monopulse feed network for interconnecting the individual antennas of said group wherein an amplitude and phase comparison of aggregate and difference diagrams in elevation and azimuth are implemented;

individual antennas of said group being three logarithmic-periodic crossed dipole antennas, long axes thereof proceeding inclined relative to one another such that phase centers of respectively active cross dipoles are separated by a maximum of about $0.7 \cdot \lambda$ in an entire range of operating frequencies.

5. The antenna system according to claim 4, wherein the three logarithmic-periodic crossed dipole antennas are arranged relative to one another such that the phase centers form corner points of an equilateral triangle whose base proceeds horizontally.

6. The antenna system according to claim 5, wherein the monopulse feed network has three 3 db dividers, each of said three 3 db dividers having an input respectively connected to receive signals from the three logarithmic-periodic crossed dipole antennas; respectively one output of each of first and second 3 db dividers, that have an input thereof respectively connected to the logarithmic-periodic crossed dipole antennas having their phase centers lying in the two base corner points of the equilateral triangle respectively connected to terminating impedances, and the other output of each of said two 3 db dividers respectively connected to a first input of respectively one of first and second 3 db/180° hybrid circuits each having a second input connected to an output of a third 3 db divider that has an input connected to that logarithmic-periodic crossed dipole antenna that does not lie in a base corner point of the equilateral triangle; wherein a respective difference output of the first and second 3 db/180° hybrid circuits is connected to an input of a third 3 db/180° hybrid circuit and a respective aggregate output of the first and second 3 db/180° hybrid circuits is connected to an input of a fourth 3 db/180° hybrid circuit; and wherein an overall difference signal in the elevation or, respectively, an overall difference signal in the azimuth appears at first and second outputs of the third 3 db/180° hybrid circuit and an overall aggregate signal appears at an aggregate output of, the fourth 3 db/180° hybrid circuit that also has a difference output connected to a further terminating impedance.

7. The antenna system according to claim 4, wherein the three logarithmic-periodic crossed dipole antennas are arranged such relative to one another such that the phase centers form corner points of an equilateral triangle whose base proceeds horizontally.

8. The antenna system according to claim 7, wherein the monopulse feed network has three 3 db dividers, each of said three 3 db dividers having an input respectively connected to the three logarithmic-periodic crossed dipole antennas signals; respectively one output of each of first and second 3 db dividers, that have an input thereof respectively connected to the logarithmic-periodic crossed dipole antennas having their phase centers lying in the two base corner points of the equilateral triangle respectively connected to terminating impedances, and the other output of each of said two 3 db dividers respectively connected to a first input of respectively one of first and second 3 db/180° hybrid circuits each having a second input connected to an output of a third 3 db divider that has an input connected to that logarithmic-periodic crossed dipole antenna that does not lie in a base corner point of the equilateral triangle; wherein a respective difference output of the first and second 3 db/180° hybrid circuits is connected to an input of a third 3 db/180° hybrid circuit and a respective aggregate output of the first and second 3 db/180° hybrid circuits is connected to an input of a fourth 3 db/180° hybrid circuit; and wherein a overall difference signal in the elevation or, respectively, an overall difference signal in the azimuth appears at first and second outputs of the third 3 db/180° hybrid circuit and an overall aggregate signal appears at an aggregate output of the fourth 3 db/180° hybrid circuit that also has a difference output connected to a further terminating impedance.

9. The antenna system according to claim 4, wherein the dipoles of the logarithmic-periodic crossed dipole antennas are half wave dipoles whose ends are capacitatively loaded.

10. The antenna system according to claim 4, wherein the group composed of the logarithmic-periodic crossed dipole antennas is accommodated in the front of the missile such that free spaces result in a missile cross section of the missile where further sensors are located.

11. An RF homing head antenna system that is very broadband over a plurality of octaves and that is accommodated in a front portion of a missile suitable for housing radar devices, comprising:

a group of individual antennas attached in close spatial proximity on a dielectric carrier plate;

a monopulse feed network for interconnecting the individual antennas of said group wherein an amplitude and phase comparison of aggregate and difference diagrams in elevation and azimuth are implemented;

individual antennas of said group having at least three logarithmic-periodic crossed dipole antennas, long axes thereof proceeding inclined relative to one another such that phase centers of respectively active cross dipoles are separated by a maximum of about $0.7 \cdot \lambda$ in an entire range of operating frequencies.

12. The antenna system according to claim 11, wherein the dipoles of the logarithmic-periodic crossed dipole antennas are half wave dipoles whose ends are capacitatively loaded.

13. The antenna system according to claim 11, wherein the group composed of the logarithmic-periodic crossed dipole antennas is accommodated in the front of the missile such that free spaces result in a missile cross section of the missile where further sensors are located.

14. The antenna system according to claim 11, wherein said group of individual antennas has four logarithmic-periodic crossed dipole antennas.

15. The antenna system according to claim 11, wherein said group of individual antennas has three logarithmic-periodic crossed dipole antennas.

16. The antenna system according to claim 15, wherein the monopulse feed network has three 3 db dividers, each of said three 3 db dividers having an input respectively connected to receive signals from the three logarithmic-periodic crossed dipole antennas signals; respectively one output of each of first and second 3 db dividers, that have an input thereof respectively connected to the logarithmic-periodic crossed dipole antennas having their phase centers lying in the two base corner points of the equilateral triangle respectively connected to terminating impedances, and the other output of each of said two 3 db dividers respectively connected to a first input of respectively one of first and second 3 db/180° hybrid circuits each having a second input connected to an output of a third 3 db divider that has an input connected to that logarithmic-periodic crossed dipole antenna that does not lie in a base corner point of the equilateral triangle; wherein a respective difference output of the first and second 3 db/180° hybrid circuits is connected to an input of a third 3 db/180° hybrid circuit and a respective aggregate output of the first and second 3 db/180° hybrid circuits is connected to an input of a fourth 3 db/180° hybrid circuit; and wherein a overall difference signal in the elevation or, respectively, an overall difference signal in the azimuth appears at first and second outputs of the third 3 db/180° hybrid circuit and an overall aggregate signal appears at an aggregate output of the fourth 3 db/180° hybrid circuit that also has a difference output connected to a further terminating impedance.

* * * * *